US006129109A

United States Patent [19]

Humber

[11] Patent Number: 6,129,109

[45] Date of Patent: Oct. 10, 2000

[54] WASHER BOX

[75] Inventor: Jeffrey A. Humber, Memphis, Tenn.

[73] Assignee: IPS Corporation, Collierville, Tenn.

[21] Appl. No.: 09/442,714

[22] Filed: Nov. 18, 1999

[51] Int. Cl.[7] ..... F16L 5/00; A47B 67/02

[52] U.S. Cl. ..... 137/360; 312/229; 312/242

[58] Field of Search ..... 137/360; 312/229, 312/242

[56] References Cited

U.S. PATENT DOCUMENTS

| | | | |
|---|---|---|---|
| 3,718,154 | 2/1973 | Doumany . | |
| 3,831,624 | 8/1974 | Doumany | 137/360 |
| 3,834,781 | 9/1974 | Logsdon . | |
| 3,847,175 | 11/1974 | Anderson . | |
| 3,862,433 | 1/1975 | Rousselet . | |
| 3,996,959 | 12/1976 | Caruth . | |
| 4,158,471 | 6/1979 | Logsdon | 312/229 |
| 4,410,004 | 10/1983 | Kifer et al. . | |
| 4,637,422 | 1/1987 | Izzi, Sr. . | |
| 4,716,925 | 1/1988 | Prather . | |
| 4,865,072 | 9/1989 | Logsdon | 137/360 |
| 4,934,410 | 6/1990 | Humber . | |
| 5,261,444 | 11/1993 | Childers . | |
| 5,476,183 | 12/1995 | Harpenau . | |
| 5,538,033 | 7/1996 | Condon . | |

*Primary Examiner*—A. Michael Chambers
*Attorney, Agent, or Firm*—Samuels, Gauthier & Stevens

[57] ABSTRACT

A washer box has a hollow housing with top and bottom walls and a front wall defining a window providing access to the housing interior. A pair of laterally spaced ports in the bottom wall are aligned in a first reference plane parallel to and spaced rearwardly from the front wall, and are configured and arranged to accommodate the connection of hot and cold water supply lines to valves located within the housing. A pair coaxially aligned alternatively useable drain openings in the top and bottom walls are located rearwardly of the first reference plane in a second reference plane extending perpendicular to the first reference plane and bisecting the distance between the laterally spaced ports.

4 Claims, 5 Drawing Sheets

WASHER BOX

BACKGROUND OF THE INVENTION

1. Field of the Invention

This invention relates to an improvement in so-called "washer boxes" which provide hot and cold water supply and drain connection for washing machines.

2. Description of the Prior Art

In conventional washer boxes of the type described, for example, in U.S. Pat. Nos. 3,718,154 (Doumany); 3,847,175 (Anderson); 3,862,433 (Rousselet); 3,996,959 (Caruth); and 4,637,422 (Izzi), the position of the drain connections unduly limits the adaptability of the box to different hookup configurations. Other drawbacks include the lack of knock-out test caps at the drain connections to facilitate pressure testing of the drain lines, and inconveniently recessed valves which are difficult to access and operate.

The present invention addresses these problems by providing an improved washer box configuration having top, bottom, front and rear wall, with hot and cold water supply ports located in the bottom wall and aligned in a common plane parallel to the front wall, and with coaxially aligned alternatively useable drain openings located rearwardly of that plane in the top and bottom walls. The rearward location of the drain openings accommodates any number of differently configured hot and cold water supply connections, including those in which the supply lines extend horizontally or vertically across the drain pipe.

The rearward positioning of the drain openings is advantageously accommodated by a rearwardly protruding boss in the rear wall of the box. The drain openings are initially sealed by integrally formed knock-out caps which may be removed after the drain lines have been pressures tested. The frontal location of the water supply ports allows the control valves to be conventionally positioned for easy access through a window in the front wall.

These and other features and advantages of the present invention will now be described in greater detail with reference to the accompanying drawings, wherein:

DETAILED DESCRIPTION OF PREFERRED EMBODIMENT

Figure 1:
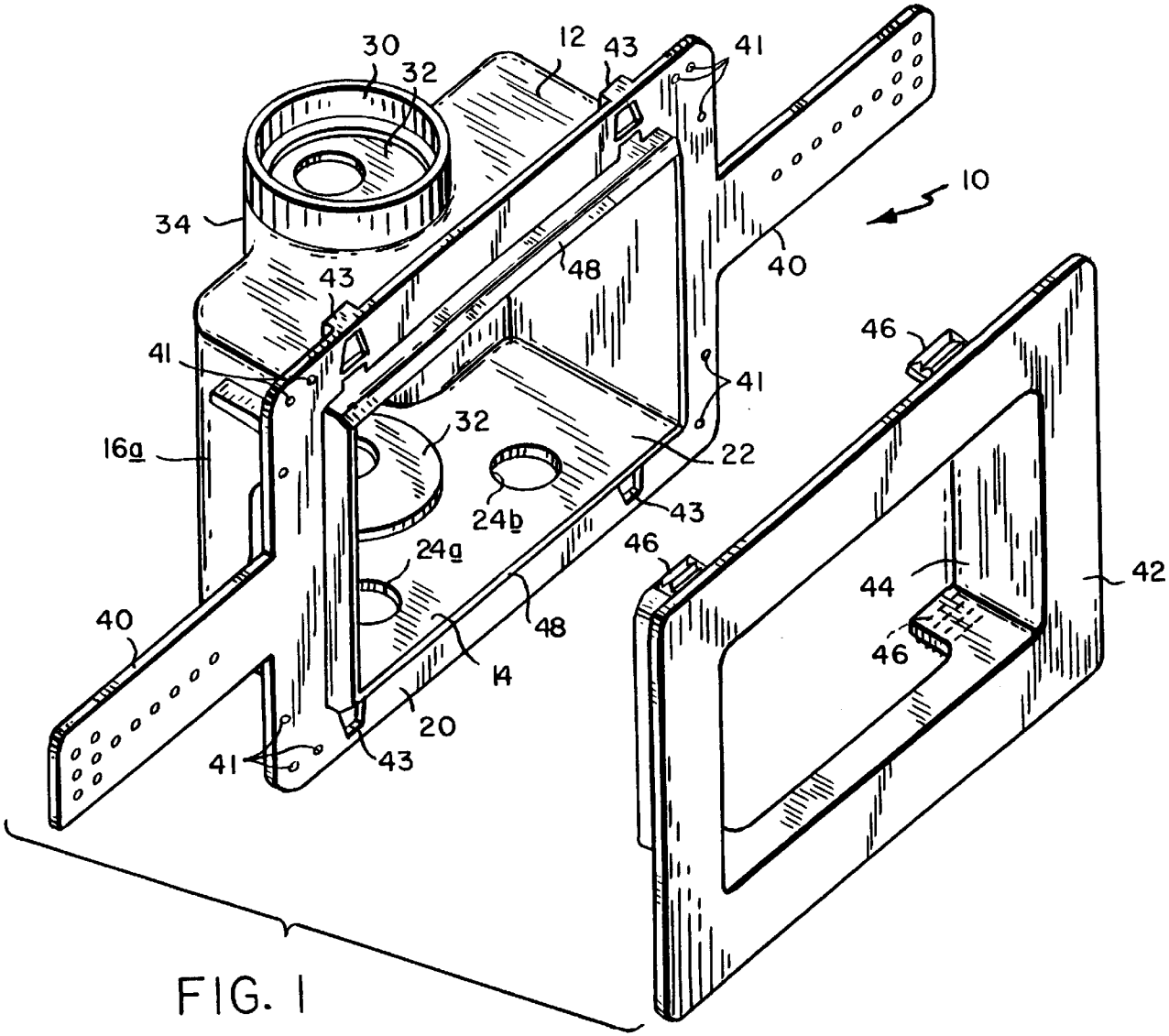
FIG. 1 is a partially exploded front perspective view of a washer box in accordance with the present invention.
Figure 2:
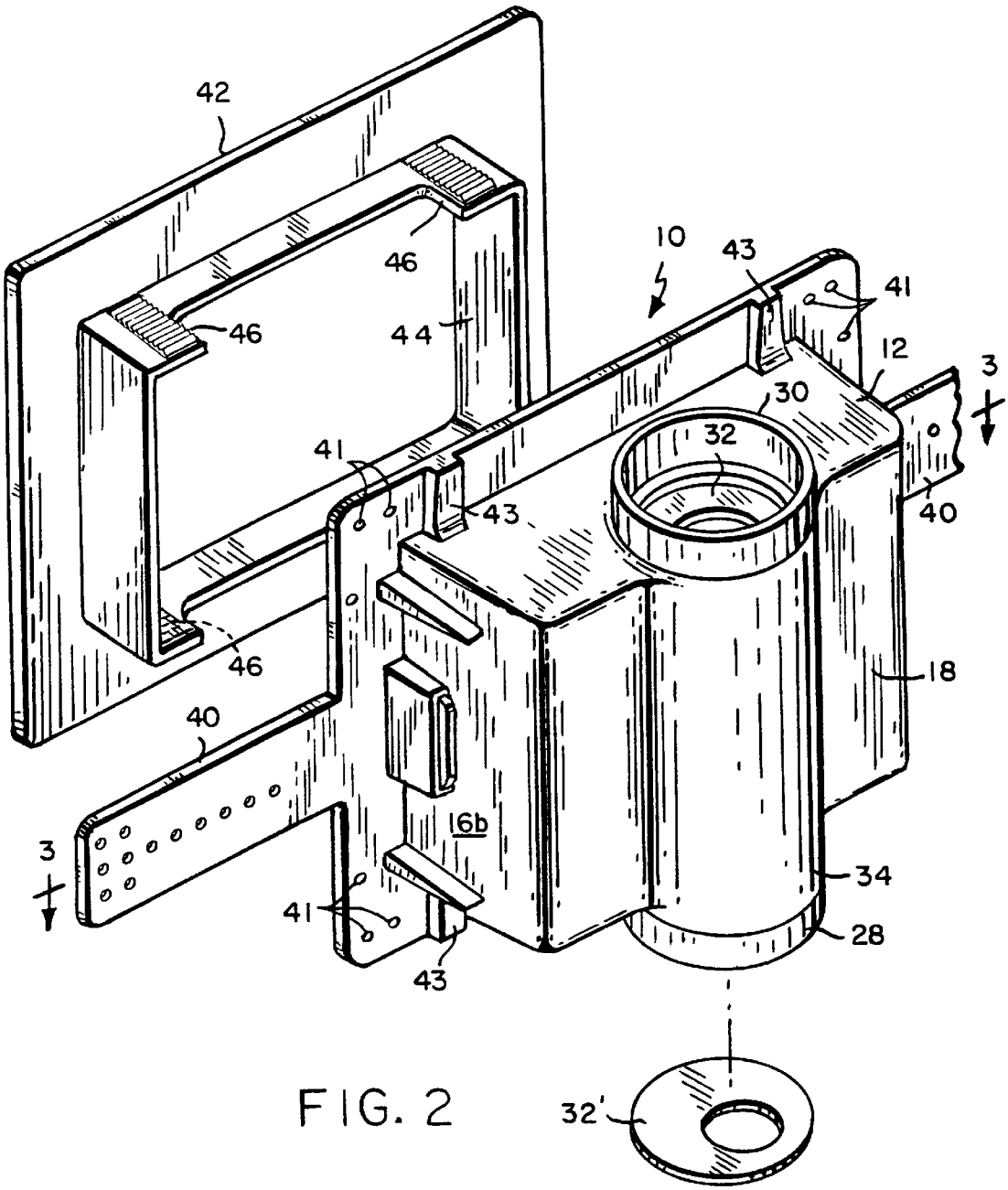
FIG. 2 is a partially exploded rear perspective view of the washer box.
Figure 3:
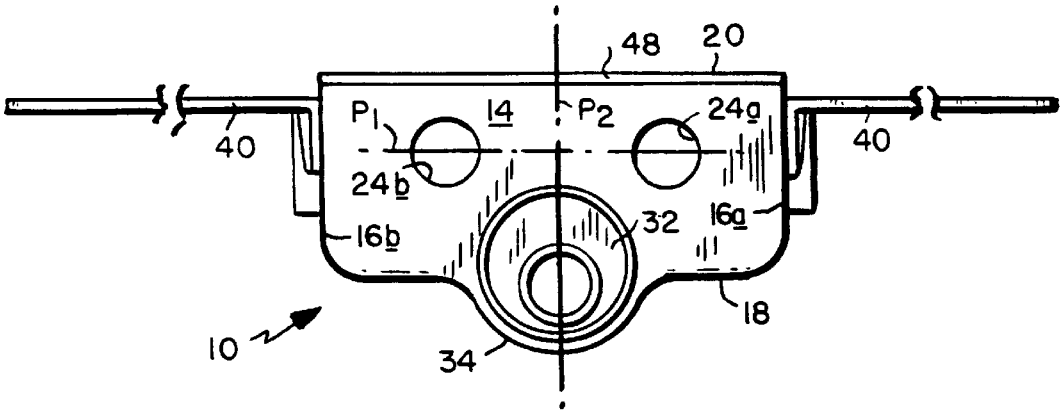
FIG. 3 is a horizontal sectional view taken along line 3—3 of FIG. 2.

Referring initially to FIGS. 1–3, a washer box in accordance with the present invention is generally depicted at 10. The box comprises a hollow housing having a top wall 12, a bottom wall 14, side walls 16*a,* 16*b,* a back wall 18, and a front wall 20 defining a window 22 providing access to the housing interior.

Figure 4:
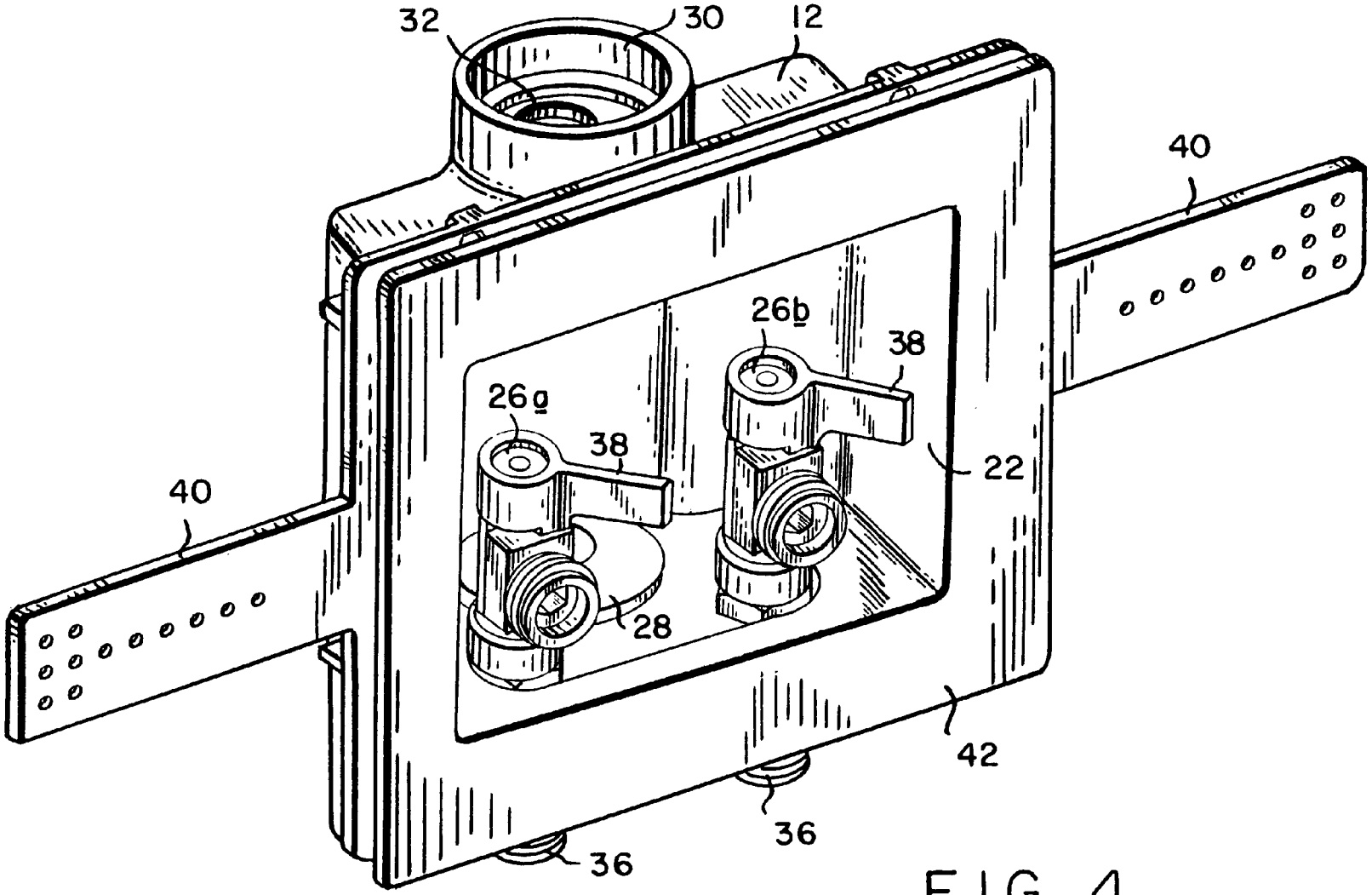
FIG. 4 is a front perspective view of the fully assembled washer box with hot and cold shut off valves in place.

The bottom wall 14 has a pair of laterally spaced ports 24*a,* 24*b* aligned in a first plane $P_1$ (shown in FIG. 3) parallel to and spaced rearwardly from the from front wall 20. It will be seen from FIG. 4 that the ports 24*a,* 24*b* are configured and arranged to accommodate hot and cold water shut off valves 26*a,* 26*b.*

A pair of coaxially aligned alternatively useable drains 28, 30 are provided in the bottom and top walls 14, 12. Each drain is closed and sealed by integrally formed knock-out caps 32, one being shown at 32' detached from the housing in FIG. 2. The drains 28, 30 are located rearwardly of the reference plane $P_1$ and are contained in a second reference plane $P_2$ extending at a right angle to reference plane $P_1$ and bisecting the distance between ports 24*a,* 24*b.* The drains are accommodated by a rearwardly protruding boss 34 in the rear housing wall 18.

The valves 26*a,* 26*b* have inlet connections 36 protruding exteriorly of the housing through their respective ports 24*a,* 24*b.* The forward placement of the valves 26*a,* 26*b* in the plane $P_1$ adjacent to the window 22 enhances their accessibility, particularly since their operating handles 38 are arranged to protrude through the window.

Mounting brackets 40 protrude laterally from the side walls 16*a,* 16*b* and a separate frame 42 is configured and dimensioned for mounting to the front of the housing to provide a finished appearance to the assembly. The frame has a rearwardly protruding wall 44 configured to enter the window 22, with serrated ramps 46 arranged to mechanically interengage with inwardly turned upper and lower window edges 48.

Figure 5A:
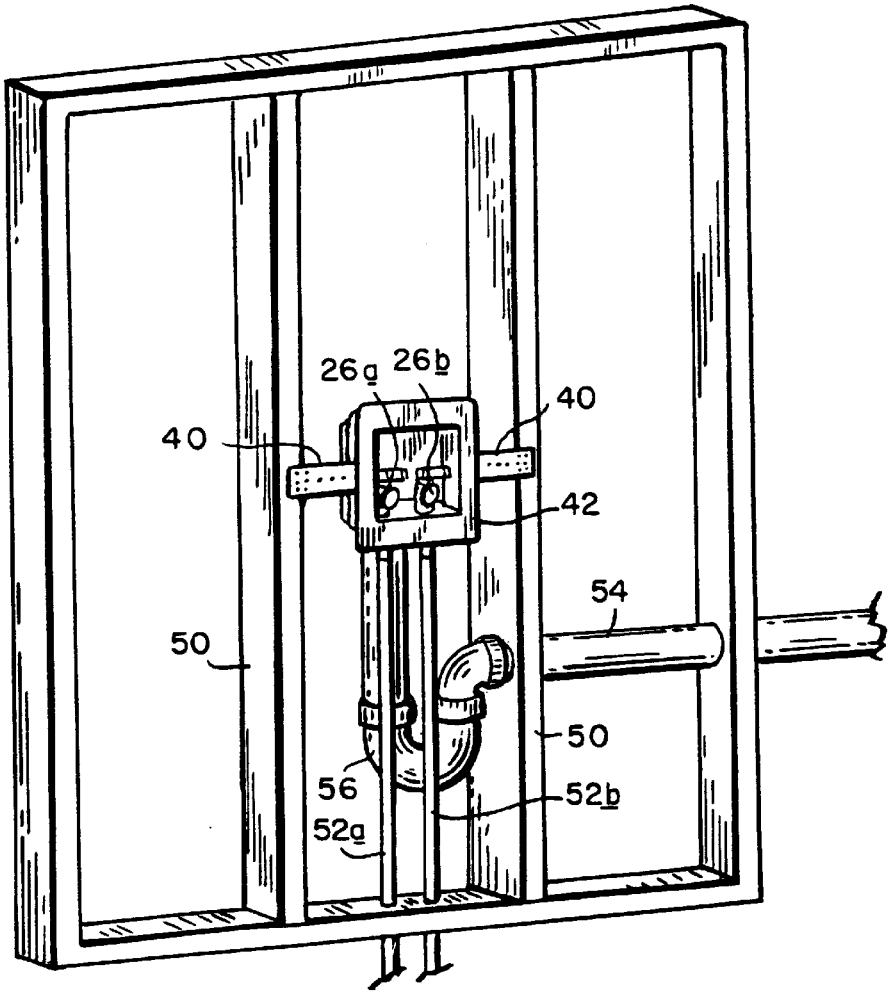
FIGS. 5A–5C are perspective views showing various hook-up configurations for the washer box.

In use, the housing may be secured by means of the mounting brackets 40 between wall studs 50, as shown for example in FIG. 5A. Alternatively, the box may be secured by nailing through holes 41 or by employing perforated metal bars (not shown) inserted through slotted bosses 43. The valves 26*a,* 26*b* are connected to vertically extending hot and cold water supply lines 52*a,* 52*b* and a drain line 54 including a trap 56 is connected to the lowermost drain opening 28. After the drain line has been pressure tested, the cap 32 on drain opening 28 is knocked out, and the housing 10 is further enclosed behind a drywall partition or the like (not shown) secured to the studs 50. An opening is cut in the drywall to expose the upper and lower window edges 48 and the valves 26*a,* 26*b,* after which the frame 42 is attached to the housing to complete the installation. The rearward location of the drain opening 28 behind the plane $P_1$ of the ports 24*a,* 24*b* is beneficial in that it allows the water supply lines 52*a,* 52*b* to conveniently extend in front of the drain line 54 and trap 56 without having to incorporate bends, elbows and the like in the drain line.

Figure 5B:
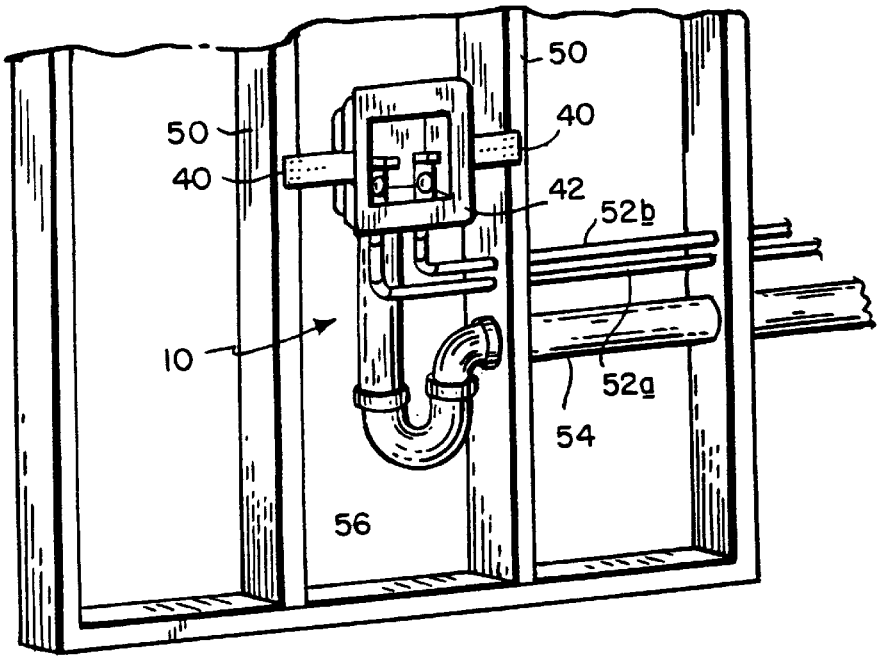

FIG. 5B shows an alternative configuration where the supply lines 52*a,* 52*b* extend horizontally rather than vertically.

Figure 5C:
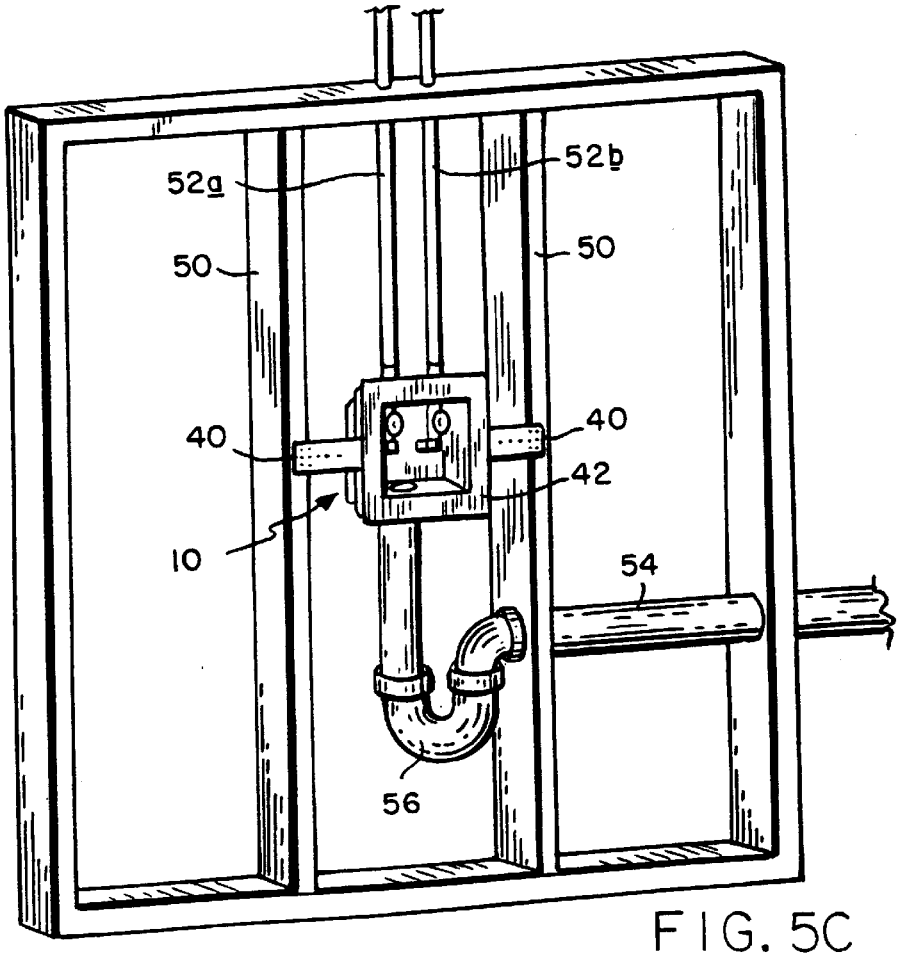

FIG. 5C shows still another configuration, where the housing has been inverted to allow the supply lines 52*a,* 52*b* to be plumbed from above. In this case, drain opening 30 is employed and drain opening 28 remains capped.

It is my intention to cover any and all changes and modification to the above-described washer box which do not depart from the spirit and scope of our invention as defined by the claims appended hereto. For example, the manner in which the frame 42 is secured to the front of the housing 10 may be varied to include any known means including screws, rivets, snaplocks and the like. Preferably, the housing 10 and frame 42 each comprise components molded of a suitable plastic material. Alternatively, however, at least the housing may comprise multiple separately molded elements configured for interlocked assembly.

I claim:

1. A washer box comprising:

a hollow housing having top and bottom walls and a front wall defining a window providing access to the housing interior;

a pair of laterally spaced ports in said bottom wall, said ports being aligned in a first plane parallel to and spaced rearwardly from said front wall, and being configured and arranged to accommodate the connection of hot and cold water supply lines to valves located within said housing; and a pair coaxially aligned alternatively useable drain openings in said top and bottom walls, said drain openings being located rearwardly of said first plane in a second plane extending perpendicular to said first plane and bisecting the distance between said ports.

2. The washer box of claim 1 wherein said drain openings are accommodated by a rearwardly protruding boss in a rear wall of said housing.

3. The washer box of claims 1 or 2 wherein said drain openings are closed by integrally formed caps adapted to be knocked out of their respective walls.

4. The washer box of claim 1 further comprising control valves arranged in said housing, said control valves having inlet connections protruding through said ports and outlet connections accessible via said window, said valves being operable by handles which protrude through said window to the exterior of said housing.

* * * * *